United States Patent [19]

Bühner et al.

[11] 4,456,229

[45] Jun. 26, 1984

[54] PIG-CHARGING APPARATUS FOR A HOT-CHAMBER PRESSURE-DIECASTING MACHINE

[75] Inventors: Ernst Bühner, Schmalwasser; Ottmar Zink; Günter Hahn, both of Bad Neustadt, all of Fed. Rep. of Germany

[73] Assignee: Preh Elektrofeinmechanische Werke Jakob Preh Nachf. GmbH & Co., Bad Neustadt, Fed. Rep. of Germany

[21] Appl. No.: 425,635

[22] Filed: Sep. 28, 1982

[30] Foreign Application Priority Data

Dec. 7, 1981 [DE] Fed. Rep. of Germany ..... 3148344

[51] Int. Cl.[3] ..... F27B 9/38

[52] U.S. Cl. ..... 266/95; 266/78; 266/200; 266/900; 432/239

[58] Field of Search ..... 266/94, 95, 78, 206, 266/200, 900; 222/167, 144; 432/239, 243, 246, 234; 414/199, 200

[56] References Cited

U.S. PATENT DOCUMENTS

| | | | |
|---|---|---|---|
| 1,032,306 | 7/1912 | Spencer | 266/94 |
| 1,138,743 | 5/1915 | Froehlich | 266/94 |
| 2,224,081 | 12/1940 | Jung | 266/95 |
| 2,245,275 | 6/1941 | Jung et al. | 266/95 |
| 2,709,529 | 5/1955 | Kleff, Jr. et al. | 266/900 |
| 4,067,463 | 1/1978 | Larsen et al. | 214/35 |

FOREIGN PATENT DOCUMENTS

| | | |
|---|---|---|
| PS553741 | 6/1932 | Fed. Rep. of Germany . |
| OS2452961 | 9/1976 | Fed. Rep. of Germany . |

OTHER PUBLICATIONS

German Publication titled "Arbeitsgemeinschaft Giessereitechnik", Fachhochschule Aalen.

*Primary Examiner*—L. Dewayne Rutledge
*Assistant Examiner*—S. Kastler
*Attorney, Agent, or Firm*—Woodcock, Washburn, Kurtz, Mackiewicz & Norris

[57] ABSTRACT

An automatic pig-charging apparatus for hot-chamber pressure-diecasting machines is described, which enable small parts to be manufactured e.g., a Zamak alloy especially under mass production conditions. Excessive fluctuations of the level of the liquid metal melt have prove to have disadvantageous effects on the quality of small parts, and on the service lives of the pressure-diecasting machines and dies. The aim must accordingly be to minimize the fluctuations. The present invention provides a control system, which keeps the liquid metal level within narrow limits. A float switch automatically triggers a charging operation whenever the lower liquid metal level is reached. This operation involves the automatic replenishment of the liquid metal melt by addition of pigs supplied from a replenishing station.

21 Claims, 7 Drawing Figures

PIG-CHARGING APPARATUS FOR A HOT-CHAMBER PRESSURE-DIECASTING MACHINE

FIELD OF THE INVENTION

The invention relates to a pig-charging appliance for a hot-chamber pressure-diecasting machine.

BACKGROUND OF THE INVENTION

Pressure-diecasting, using for example, the so-called Zamak alloys available from the New Jersey Zinc Company, which comprise zinc, with aluminium, copper and magnesium as alloying additions, has been regarded, for a comparatively long time, as a successful economical process in the mass production of small parts for electromechanical components, especially in the case of plug-and-socket connectors and potentiometers. Parts manufactured from Zamak alloys are resistant to the atmospheric corrosion effects which are normally encountered. The natural grey layer which forms on the parts prevents the corrosion from becoming progressive. If a decorative effect is to be achieved, such parts can also be subjected to a subsequent surface-finishing process. Zamak alloys parts are usually plated with copper, nickel, chromium, cadmium or tin. With regard to the quality of the castings, and especially with regard to those of their characteristics which are relevant to production, and with regard to the quality of their surface finish, particular importance attaches to the die temperature. In addition to the die temperature, the melt temperature should also be continuously monitored. Fluctuating melt and die temperatures lead to castings of variable quality. Furthermore, the quality of the parts is influenced by a series of additional casting parameters which relate to details of the machine and casting system employed (for example, the velocity of the melt at the casting gate, dissimilar cooling conditions following the removal of the parts from the die, die-filling conditions, etc.). The machine-related casting parameters also include the influence of the liquid metal level. Comprehensive tests have shown that, for a fixed setting of the change-over point, the liquid metal level exerts an influence on the position of the melt relative to the casting gate. In the case of a first level setting, the melt stood immediately in front of the gate as the die-filling phase was initiated. The velocity of the casting piston remained constant throughout the die-filling phase, as did also the pressure to which the melt in the casting system was subjected as the die was filled. In the case of a second level setting, the liquid metal level had fallen, so that the position of the change-over point, from the first phase to the second phase, was such that the melt stood a considerable distance in front of the gate. The velocity of the casting piston decreased when the piston reached the melt in the gate, and a high pressure-peak occurred concurrently with the decrease in the velocity. In the case of a third level setting, the liquid metal level had been raised. This led to a condition in which a portion of the die cavity was already filled during the first casting phase. On this occasion, the velocity of the casting piston increased continuously as the second phase was initiated. Only in the second half of the die-filling phase did the velocity of the casting piston reach a constant value. With the increase in the velocity, the pressure in the casting system, to which the melt was subjected during the die-filling phase, also increased, but scarcely any pressure-peak could be recognised. The occurrence of pressure-peaks during the die-filling phase must be taken into account with regard to the stressing of the pressure-casting die which forms part of the closing system of the pressure-diecasting machine, the occurrence of these pressure-peaks being dependent on the setting of the pressure-diecasting machine, the position of the change-over point, and the liquid metal level. High pressure-peaks can lead to the occurrence of fatigue fractures in the columns in the closing mechanism of the pressure-decreasing machine.

From the above considerations, it is evident that the liquid metal level represents an important casting parameter, and that efforts should be made to minimise the fluctuations to which it is subject. Hitherto, the charging of the holding vessel, which can be heated and is filled with the liquid metal melt, was carried out in a manner according to which the machine operator had to decide, by visually assessing the liquid metal level, whether or not it was necessary to replenish the melt with a new pig. The level typically fluctuated by ±2.5 cm.

OBJECT OF THE INVENTION

The object of the present invention is to discover a pig-charging appliance for a hot-chamber pressure-diecasting machine whereby the fluctuations of the liquid metal level can be kept within considerably narrower limits.

SUMMARY OF THE INVENTION

The control system, of the invention, satisfies the above discussed needs of the art and object of the invention by provision of a pig-charging apparatus and control system in which fluctuations of the liquid metal level are reduced to ±0.5 cm. This leads, in turn, to a more uniform production rate, thus resulting in better utilisation of the machine. In addition, a marked improvement occurs in the quality of the parts produced. The proposed control system also leads to the further economic advantage in that several machines can be supervised by one operator, something which was impossible in the past because of the continuous observation of the liquid metal level. Furthermore, the working conditions for the operators are improved, in the sense of a more humane environment, in that no operator need remain so often in the vicinity of the holding vessel containing the liquid metal melt, where he is exposed to the heat which prevails in this area, since the machines can run on their own for a comparatively long period.

BRIEF DESCRIPTION OF THE DRAWINGS

In the following text, the invention is explained in more detail, for an illustrative embodiment, by reference to the drawings, in which.

DESCRIPTION OF THE PREFERRED EMBODIMENT

Figure 1:
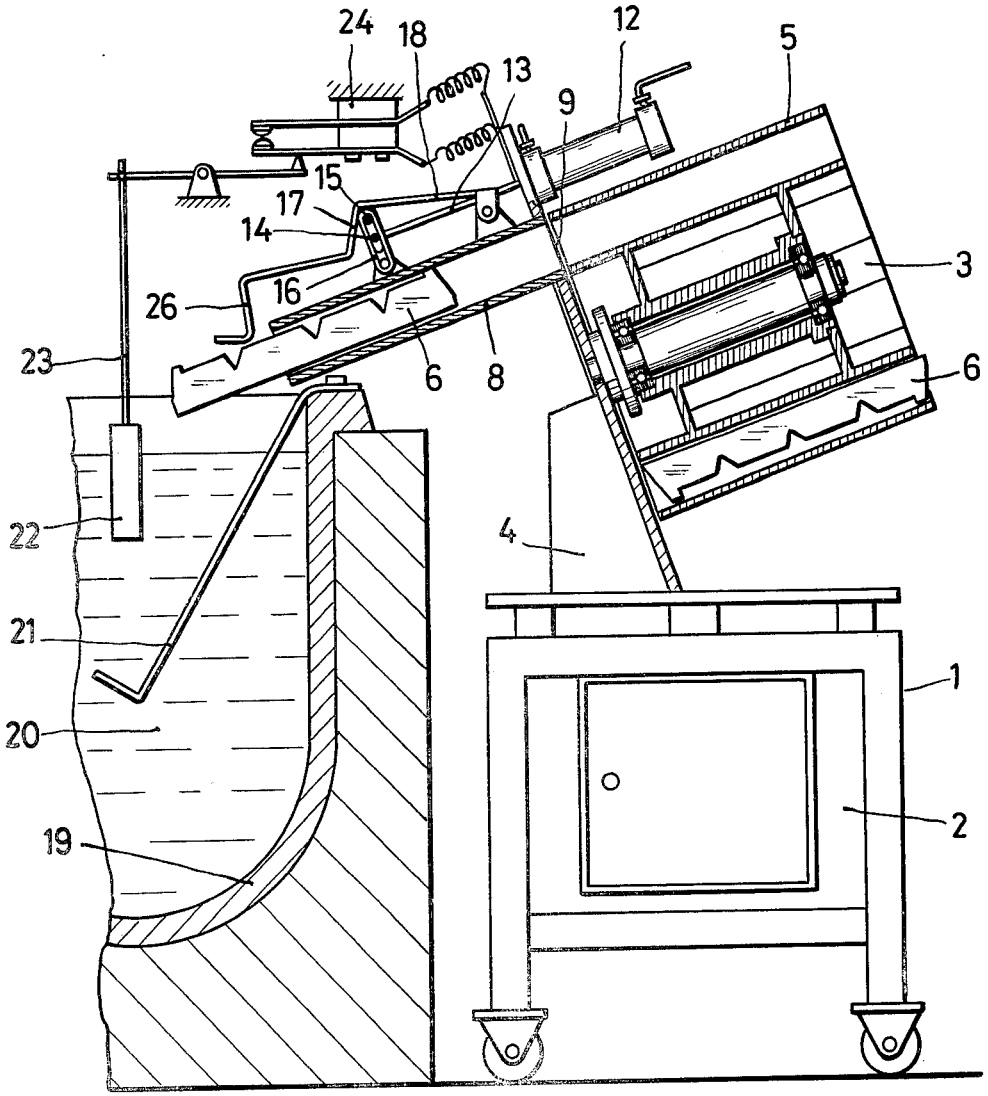
FIG. 1 shows a side view of a controlled pig-charging apparatus, partially in section.
Figure 2:
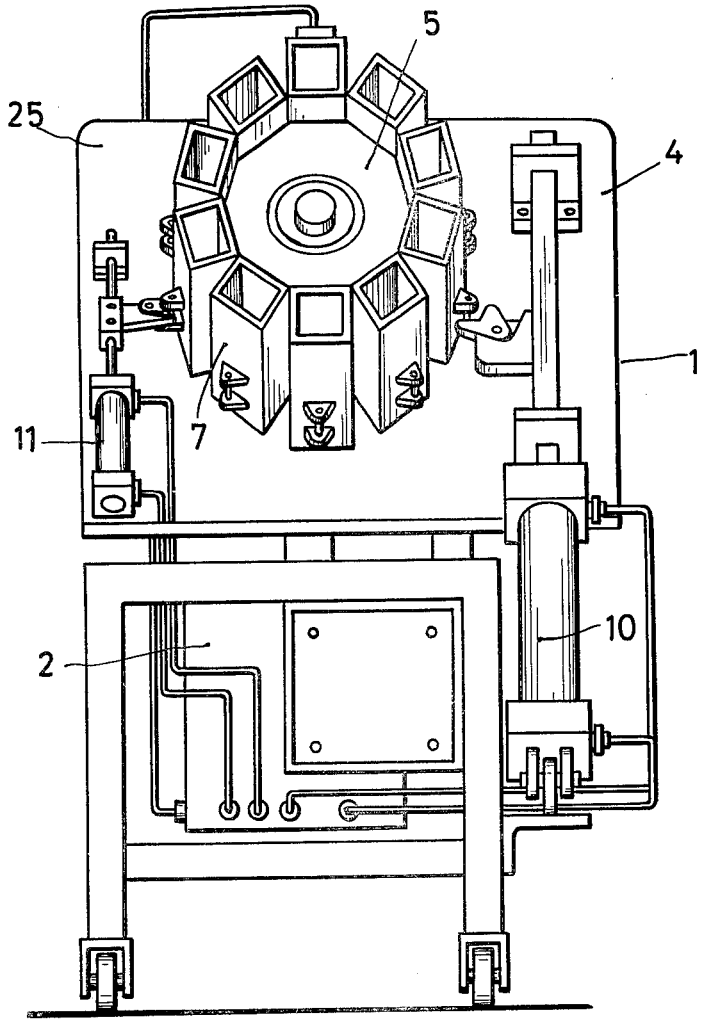
FIG. 2 shows a front view of the pig-charging apparatus of the invention

The structural design of the pig-charging apparatus is represented in FIGS. 1 and 2, an the circuit diagrams for the associated electropneumatic control system are shown in FIGS. 3 to 7. The preferred embodiment of an automatic pig-charging apparatus, as described here, employs pneumatic drive means. An illustrative embodiment would of course, also be conceivable, in which electromagnetic, electrical or hydraulic drive means are employed.

The pig-charging apparatus represented in FIGS. 1 and 2 essentially comprises a replenishing station 1, for supplying alloy pigs 6 to a vessel 19 which supplies molten alloy to the die casting machine (not shown). The apparatus comprises a lower portion 2 and an upper portion 3. The electrical circuit and the valves for pneumatically triggering the cylinders are located in the lower portion 2. The entire machine can be moved, by means of castors so that it can easily be shifted from one machine to another, as required. Otherwise, the holding vessel 19 is the only portion of the pressure-diecasting machine which is indicated, and only part of this vessel is shown. The actual pressure-diecasting machine is of no importance with regard to the invention, so that its representation has been dispensed with.

The upper portion 3 is composed of a rotatable part 5 and a supporting member 4 which is attached to the lower portion 2 and which possesses a retaining plate 25 which is arranged in an inclined attitude. The rotatable part 5 is attached to this retaining plate 25, in a manner permitting rotation. The rotatable part 5 itself comprises a central portion and a plurality of parallel magazines 7 which are installed in a revolver-like arrangement. The pigs 6 are pushed into these magazines and are held by gravity in an inclined attitude. In the case of the illustrative embodiment represented in the Figures, 10 magazines are provided, but any other number is also conceivable. The angular inclination of the magazines is between 20 and 30 degrees, preferably 25 degrees. The angle has been selected so that the pigs, overcoming the adhesive friction, can still slide easily into the holding vessel 19, without excessive splashing as they plunge in. In order to further control this process of sliding-in, a slide 21 is provided inside the holding vessel 19, this slide being arranged to form an incline and having a bent-over portion at one end as a stop.

A circular arrangement of the magazines has been preferred, rather than a linear arrangement, in order to minimise the drive-effort during the process of rotating the rotatable part. Had a linear arrangement been chosen, the pigs would have had, for example, to be lifted up, or, if they had previously been positioned at a considerably higher level, with a greater expenditure of energy, they could have been allowed to fall down. In any case, a horizontal arrangement would still be conceivable. The circular arrangement has the advantage that, at least when the magazines are fully loaded, some of the pigs contribute to the torque due to their weight. The rotation of the rotatable part 5, into an angular stopping position, is effected with the aid of a shifting cylinder 10, and its rotation is stopped with the aid of a locking cylinder 11. The precise mode of operation will be explained later.

A holding duct 8 is located on the other side of the inclined panel 25, this side being opposite to the rotatable part 5, this duct having the same inclined attitude as the magazines and being attached, at one end, to the panel 25. At this end, an opening 9 is cut in the panel 25, so that the pig can slide from the magazine, through the opening 9, and into the holding duct. The magazines themselves are open at both ends.

In order to prevent the pig 6 from plunging out of the holding duct 8 at a comparatively high speed, straight away into the metal melt 20 and possibly causing splashing, the pig is held securely in the holding duct 8, the front opening of which is not unblocked until required. This means that this opening controllably opened and closed. For this purpose the piston rod 13 of the blocking cylinder 12 possesses, at its end, a lateral driving-projection 14 which projects into a guide slot 15 of a pivoting lever 16 which can swing about a pivot-point. The pivoting lever 16 pivots a release lever 18 which is likewise capable of being deflected about a pivot-point. This release lever 18 possesses, approximately at its mid-point, a first bent-over portion 17, which interacts with the pivoting lever 16 and a second bent-over portion 26, located at the end, closes the opening in the holding duct 8.

The level of the molten metal 20 is sensed with the aid of a switching device which comprises a float 22, a linkage 23, which can pivot about a pivot-point, and a float-operated switch 24.

Figure 3:
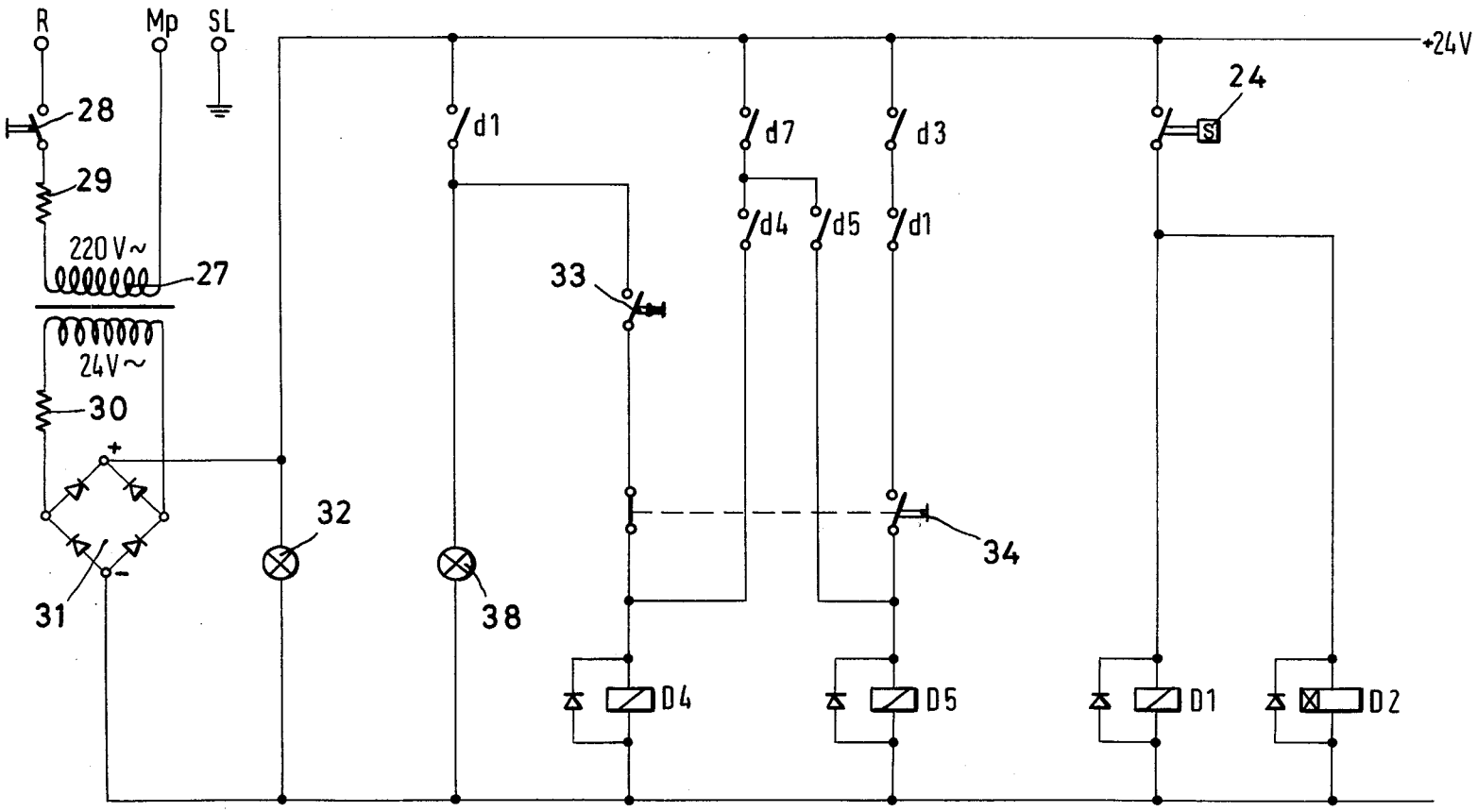
FIG. 3 shows a circuit diagram of a portion of the electrical control system.
Figure 4:
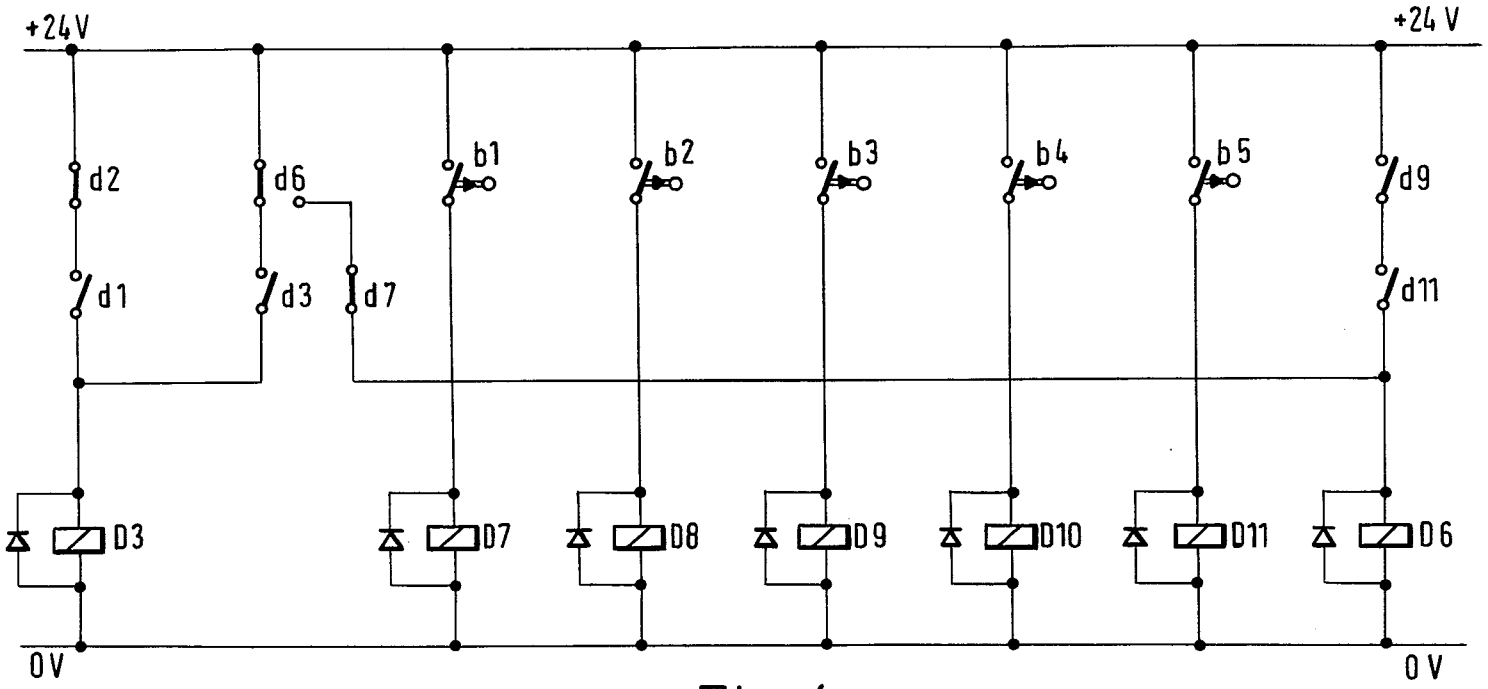
FIG. 4 shows a circuit diagram of a further portion of the electrical control system.
Figure 5:
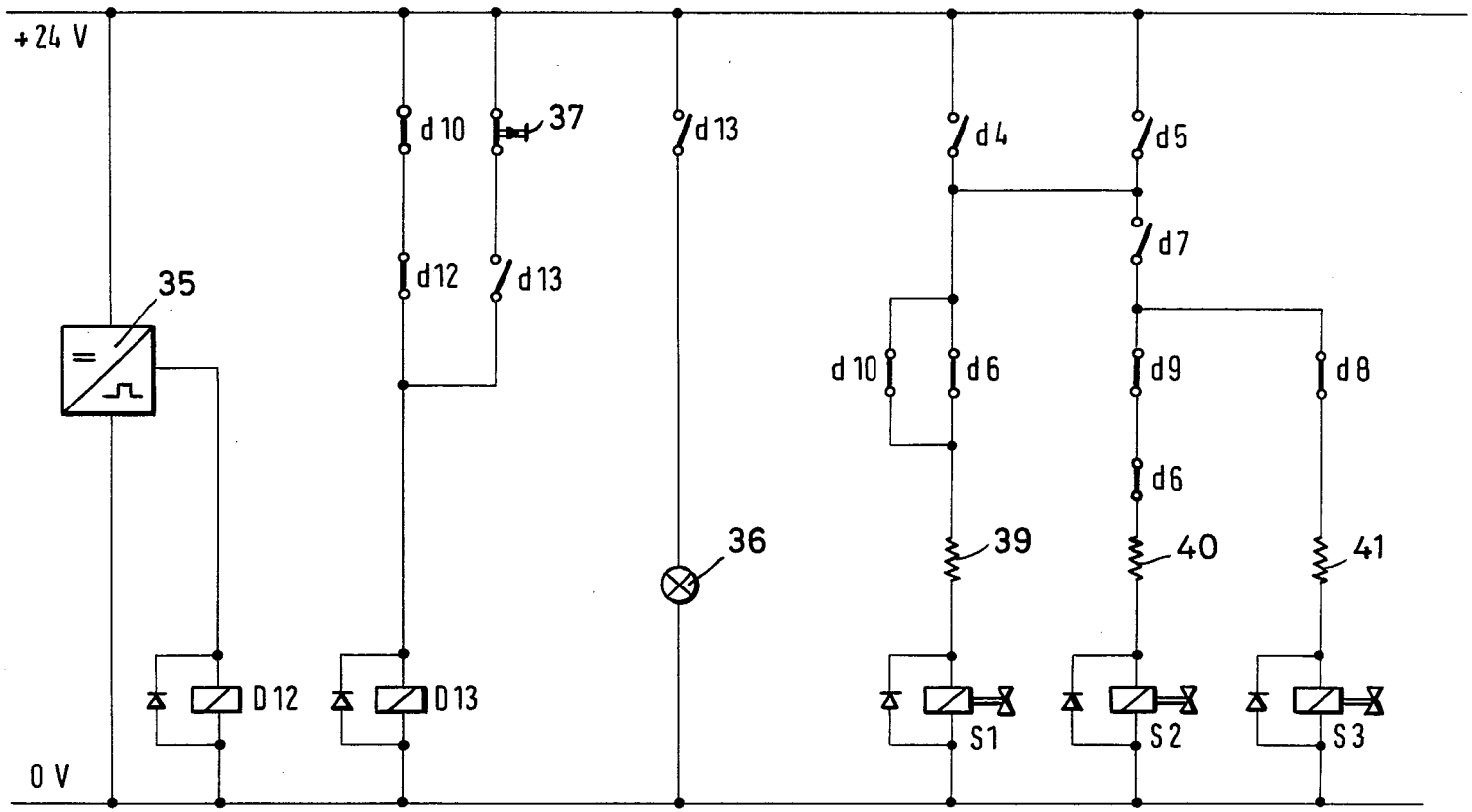
FIG. 5 shows a circuit diagram of a further portion of the electrical control system.

The electrical portion of the control system for triggering the pneumatic cylinders is represented in FIGS. 3 to 5. A +24-volt DC supply is required which is obtained from the mains voltage, which is applied, via a mains switch 28 and a first fuse 29, to the primary winding of a transformer 27. A rectifier 31 is connected, via a second fuse 30, in the secondary circuit, this rectifier delivering the desired DC voltage of +24 volts. When the mains switch is closed, a first control lamp 32 comes on.

There is, in principle, the possibility of selecting manual replenishment of the pigs, one at a time, or automatic replenishment. For this purpose, a manual-start preselector switch 33 is available, or a preselector switch 34 for automatic operation. The float-operated switch 24 must be closed in order to enable a replenishment operation to take place. This switch applies the DC voltage to a relay D1 and, approximately two seconds later, applies it to a relay D2. In order to prevent the occurrence of damaging induced voltages, generated as the relays switch off, diodes are connected in parallel to all the windings of the relays. Two series-connected contacts d1 and d2 trigger a further relay D3, one contact acting as a break-contact, and the other acting as a make-contact. The contacts d3 and d6, which are likewise series-connected, are connected in parallel to the series-connected contacts d1 and d2. The contact d6 is a switchover contact, while the contact d3 is a make-contact. When the relay D1 pulls in, the contact d1 closes and voltage is applied to the relay D3. After a delay of approximately two seconds, relay D2 also pulls in and contact d2 opens. This would cause the relay D3 to drop out, were it not holding itself in the excited state via the parallel circuit, since the contact d3 has, in the meantime, closed. This fail-safe circuit has been provided in order to prevent the metal melt from being continuously replenished with pigs if the float-operated switch unintentionally sticks in the closed position. Automatic replenishment consequently takes place only when the current supply to the float-operated switch 24 is interrupted once between the individual cycles.

An inductive proximity switch 35, to which the DC voltage is applied, monitors the penultimate magazine as to whether a pig is present, or not. If the penultimate magazine is empty, voltage is applied to a pig-monitoring relay D12. Voltage is applied, via two series-connected, closed contacts d10 and d12, to an indicator relay D13, this meaning that voltage is continuously applied to the indicator relay D13. If now the relay D12 pulls in, the contact d12 opens and the indicator relay D13 drops out, thus causing the contact d13, which is connected parallel to the contacts d10 and d12, to close. In addition, a further contact d13 closes, which applies voltage to an indicator lamp 36. This indicates that there are no more pigs in the magazines and that they must be reloaded. This indication remains until the voltage is removed from the indicator relay D13, by means of a cancelling button 37.

The supply voltage is applied, by a contact d1 of the relay D1, to a lamp 38, thus indicating that the float-operated switch is in the closed position. The supply voltage is applied to a relay D4 via this contact d1, the manual-start preselector switch 33 and a pair of contacts of the preselector switch 34 for automatic operation. In addition, the supply voltage can also be applied to the relay via the series-connection of the contacts D4 and D7. From the connection between the contacts d4 and d7 a further connection leads, via a contact d5, to the relay D5 to which the supply voltage can also be applied via a further pair of contacts in the preselector switch 34 and the series-connection of the contacts d1 and d3.

As can be seen from FIG. 4, the supply voltage is applied, via switch-contacts, to a further group of relays, D7, D8, D9, D10 and D11. The relay D6 is connected to the positive pole of the supply voltage via the contacts d11 and d9. In addition, there is a further, parallel branch to the positive pole, via the contact d7 and the switch-over contact d6.

As FIG. 5 shows, three magnetic valves S1, S2 and S3, are also provided, the supply voltage being applied to each of these valves via a plurality of contacts and, in each case, a fuse 39,40, or 41. The contacts d4 and d5 are connected in parallel to the positive pole of the supply voltage. From these contacts, a parallel connection of the contacts d10 and d6 leads, via the third fuse 39, to the magnetic valve S1. The supply voltage is applied to the magnetic valve S2 via the fourth fuse 40, the series-connection of the contacts d6, d9 and d7, and the parallel connection of the contacts d4 and d5. From the connection between d7 and d9, yet another connection is routed, via the contact d8 and the fifth fuse 41, to the magnetic valve S3. This multiple arrangement of the contacts represents a safety precaution to prevent a movement-action from being initiated before the previous action has been started, or completely concluded.

In the following, the sequence corresponding to one cycle is described by reference to the timing-diagram represented in FIG. 7. The holding duct 8 is open at the beginning of each cycle. This means that the lever system which effects the closing of the opening of the holding duct 8 is in the raised or in "OPEN" position. At the same time, the locking mechanism comprising cylinder 11 is in the "CLOSED" position and the piston rod of the shifting cylinder 10 is in the "BACK" position. In phase 1, the lever system now closes the holding duct, and the locking mechanism moves to the "OPEN" position. In phase 2, the piston rod of the shifting cylinder 10 moves into the "FORWARD" position, and effects a rotation of the rotatable part 5. On completion of the rotation, the locking mechanism returns to the "CLOSED" position, in order to prevent any further rotation. The pig present in the magazine can then slide through the opening 9 into the holding duct 8 and strike the lever end 26 which acts as a stop. In phase 3, the piston rod of the shifting cylinder 10 returns to the "BACK" position. In phase 4 the lever system now unblocks the opening of the holding duct, and the pig can slide into the liquid metal melt.

Figure 6:
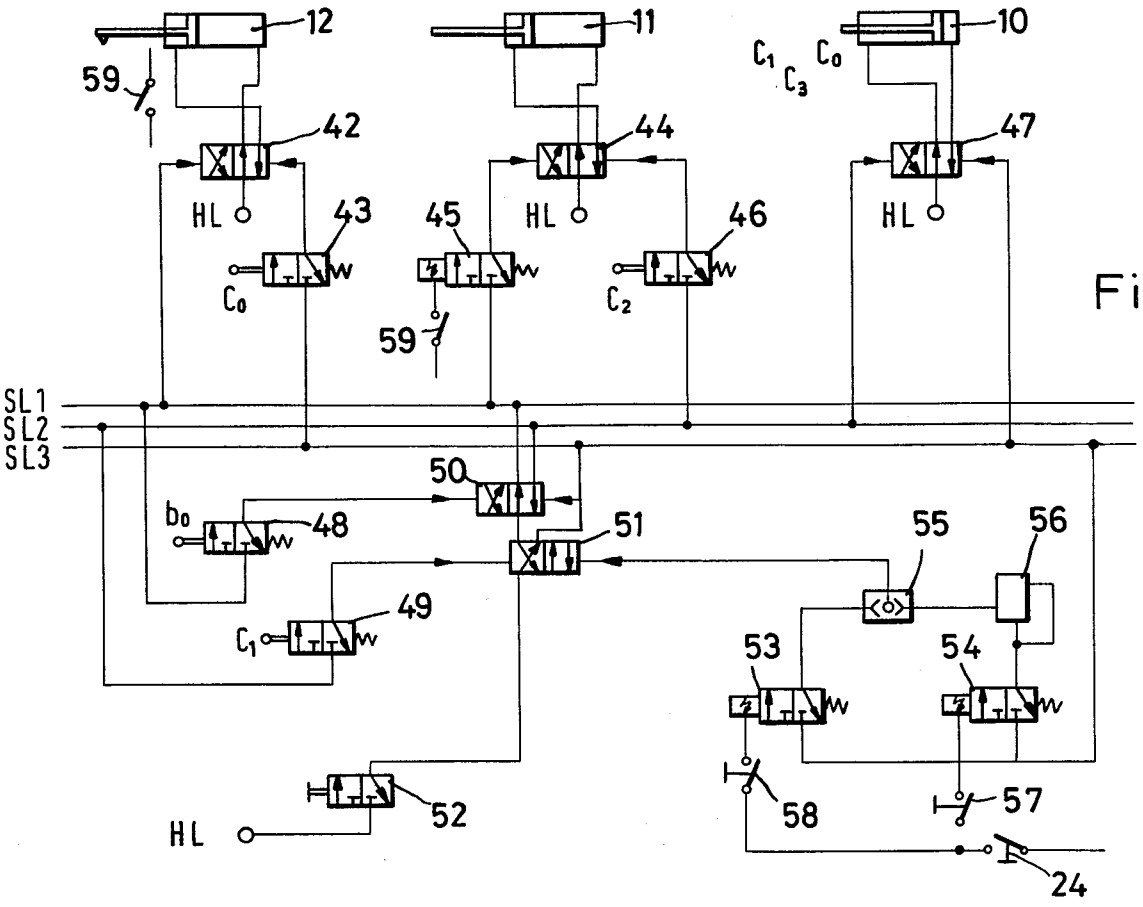
FIG. 6 shows a circuit diagram of the pneumatic portion of the control system.

The pneumatic portion of the control system is shown in FIG. 6. A total of 3 cylinders are present, namely the blocking cylinder 12, the locking cylinder 11, and the shifting cylinder 10. The forward and reverse operation of the individual cylinders is controlled by three control lines SL1, SL2 and SL3. In this arrangement, the blocking cylinder 12 is connected to the first control line SL1 and to the third control line SL3, the locking cylinder is connected to the first control line SL1 and to the second control line SL2, and the shifting cylinder 10 is connected to the second control line SL2 and to the third control line SL3.

The forward and reverse operation of the blocking cylinder 12 is directly controlled by a main directional control valve 42, which is a 4/2 three-way valve which can be pneumatically actuated from either side. While one side of this main directional control valve 42 is directly connected to the first control line SL1, a pilot valve 43 is located on the other side, in the other connecting line to the third control line SL3, this pilot valve being a two-way valve which can be actuated against the force of a return spring. This valve 43 is actuated by the piston rod of the shifting cylinder 10. For example, a microswitch juxtaposed to cylinder 11 could output a signal $C_0$ to valve 43 when the piston rod hits the switch. All this is shown by the symbol $C_0$ at cylinder 10 and at valve 43.

The forward and reverse operation of the locking cylinder 11 is controlled by a main directional control valve 44, which is also a 4/2 three-way valve which can be pneumatically actuated from either side. A pilot valve 45, which is a two-way valve, which can be actuated electrically, and which is provided with a return spring, is located in the connecting line to the first control line SL1. As soon as the piston rod of the blocking cylinder starts to move backwards, switch 59 is closed, which actuates pilot valve 45. (Switch 59 is shown in two places on the drawing, for clarity). A pilot valve 46, which is a 2-way valve, possesses a return spring, and is actuated, mechanically, by the piston rod of the shifting cylinder 10, is located in the connecting line to the second control line SL2. (Again, this is shown by the symbol $C_2$).

The forward and backward operation of the shifting cylinder 10 is controlled by a main directional control valve 47, which is a 3-way valve which can be pneumatically actuated from either side, and which is directly connected to the second control line SL2 and to the third control line SL3.

For a better understanding, the float-operated switch 24 is once again represented in FIG. 6. This switch electrically actuates two 2-way valves, 53 and 54, which are connected in parallel. However, prior to the actuation of these valves, it is also necessary for the two switches 57 and 58 to be closed, one of these switches being an interlock switch and the other being a pushbutton switch. These switches 57 and 58 thus function, together with switch 24 as an AND-gate, for safety. On their inlet sides, 2-way valves 53 and 54 are connected to the third control line SL3. The outlets are led to a change-over valve 55, a delay-valve 56 also being located in the connection between the 2-way valve 54 and the change-over valve 55. In its turn, the change-over valve 55 controls the position of a directional valve 51, which is a 2-way valve.

The main pneumatic line is marked HL, which supplies compressed air both to the control lines SL1, SL2 and SL3, and to the three cylinders 10, 11 and 12 via values 43, 44 and 47, respectively. The compressed air can be switched to the directional control valve 51 with the aid of a main air shut-off valve 52, which can be actuated mechanically, and which takes the form of a 2-way valve.

Figure 7:
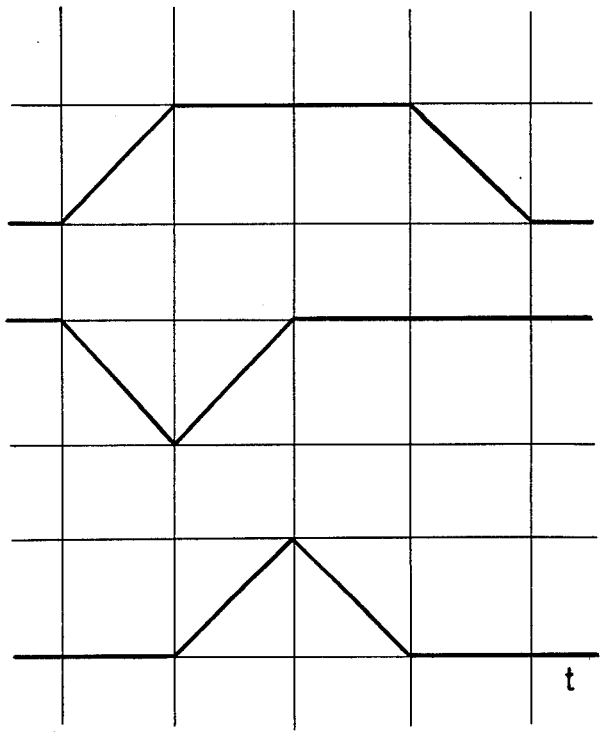
FIG. 7 shows a timing-diagram illustrating the operation of the individual cylinders.

In order to enable the forward and backward lateral movement of the piston rods in the three cylinders 10, 11 and 12 to take place in the manner represented in FIG. 7, compressed air must be admitted to the three control lines SL1, SL2 and SL3 in a sequential manner, one after the other. For this purpose, a type of "1 of 3" interconnection arrangement is provided, which comprises a first 4/2-way valve 50 and a second 4/2-way valve 51, which are series-connected, the first directional control valve 50 switching to the control lines SL1 and SL2, and the second directional control valve 51 switching to the control line SL3. The position of the first directional control valve 50 is determined by a pilot valve 48, controlled by signal $b_0$ which allows compressed air to pass through from the control line SL1 when the piston rod of the locking cylinder 11 is moving backwards. The position of the second directional control valve 51 is determined by the pilot valve 49, which is connected to the second control line SL2.

It is intended, in the following, to describe a cycle, by reference to FIG. 6 and in conjunction with FIG. 7. It is assumed that the molten metal level has fallen, and that the float-operated switch 24 is in the closed position. Either the pushbutton switch 58 or the interlock switch 57 must also be in the closed position. In addition, the main pneumatic line HL must have been turned on, manually, by means of the valve 52. The control line SL3 is consequently supplied with compressed air through valve 51. One or both of the two valves 53 and 54 is actuated, so that the compressed air reaches the valve 51 and actuates it, thus switching the main line directly to the control line SL1 through valve 50. Phase 1 (FIG. 7) is entered when the surge of compressed air in the control line SL1 actuates the valve 42, so that the piston rod of the blocking cylinder 12 starts to move backwards. This closes the holding duct 8. At the same time, the backward-moving piston rod closes switch 59, which acts, in its turn, on the valve 45, thus switching the control line SL1 through to the main directional control valve 44, which is thereby actuated. This causes the piston rod of the locking cylinder 11 to travel from the "CLOSED" position shown, backward to the "OPEN" position. When the locking mechanism is open, Phase 2 is entered, and the piston rod acts, in this return position, on the pilot valve 48, (shown by the symbol $b_0$) and actuates it. This, in turn, actuates the valve 50, so that the main line HL is now switched to the second control line SL2. Still in phase 2, the surge of compressed air in SL2 reaches the main directional control valve 47 and actuates it, thus causing the piston rod of the shifting cylinder 10 to move forward instead of backward from the position shown, advancing the next magazine 7. As it moves forward, the valve 46 is initially actuated, (indicated by symbol $C_2$) as the piston rod passes through its mid-position. In the extreme position of the piston rod, the valve 49 is actuated (symbol $C_1$) in turn actuating valve 51, so that the main line HL is switched over to the third control line SL3. Pressure in SL2 causes valve 44 to be shifted, so that at the same time, the piston rod of the locking cylinder 11 again starts to move forward, into the "CLOSED" position. The movement of the piston rod of the shifting cylinder 10 causes the rotatable magazine 5 to rotate further, through an angle corresponding to one magazine. Phase3 is entered when the surge of compressed air in the control line SL3 actuates the valve 47, and the piston rod of the shifting cylinder 10 again starts to move backwards. When it is closed (symbol $C_0$) valve 43 is triggered, switching the position of valve 42. This starts phase 4, and the piston rod of the blocking cylinder 12 again starts to move forward, so that the end of the holding duct is unblocked and the pig can slide into the melt.

We claim:

1. Pig-charging apparatus for a pressure-diecasting machine comprising:

a holding vessel, which can be heated, for receiving a liquid metal melt;

means for supply of pigs to said holding vessel;

a holding duct assembly;

a plate; and a control system for keeping the liquid metal level in the holding vessel between a lower and an upper level, comprising a switching device which automatically triggers said means for supply of pigs, whereby a pig is charged into the holding vessel when the lower liquid metal level is reached, wherein said means for supply of pigs comprises an inclined rotatable pig magazine assembly comprising plural parallel elongated, circumferentially arranged magazines, to receive and discharge the pigs, said assembly being capable of rotation through a plurality of angular stopping positions;

wherein said holding duct assembly is located opposite the rotatable magazine, this assembly comprising a holding duct open at both ends, having substantially the same inclined attitude as the rotatable magazine, and one end thereof being located in juxtaposition to the magazines of the rotatable magazine assembly, and release means for controllably opening and closing its other end; and wherein said plate is interposed between the lower ends of said inclined magazines and said holding duct assembly, and a hold in said plate is provided over the end of the holding duct juxtaposed to said magazines, whereby a pig can slide from one end of the magazines through said hole and into said holding duct.

2. Pig-charging apparatus according to claim 1, wherein said magazines are open at both ends.

3. Pig-charging apparatus according to claim 1, further comprising pneumatic drive means for rotating and stopping the rotatable magazine assembly are provided comprising pneumatic cylinder means for rotating the rotatable assembly, and for locking the assembly at one of said angular stopping positions.

4. Pig-charging apparatus according to claim 1, wherein the release means comprises a lever system moved by means of a blocking cylinder.

5. Pig-charging apparatus according to claim 4, wherein one end of the piston rod of the blocking cylinder is provided with at least one lateral driving-projection for engaging a guide-slot of a pivoting lever which acts to open and close the holding duct.

6. Pig-charging apparatus according to claim 1, wherein the holding vessel comprises a sliding surface arranged to form an incline and stop for pigs when slid into the vessel.

7. Pig-charging apparatus according to claim 1, wherein the switching device for sensing the liquid metal level comprises a float, a float linkage and a switch operated by said linkage.

8. Pig-charging apparatus according to any one of claims 1, 2, 3–7 wherein said control system comprises electrical control means for controlling discharge of said pigs into said vessel.

9. Pig-charging apparatus according to claim 8, further comprising a fail-safe circuit provided in case of failure of the float-operated switch, this circuit comprising a float-switch relay triggered by the float-operated switch and a time-delay relay triggered by the float-operated switch, wherein the contacts of these relays are series-connected with opposite polarities, and apply a voltage to a relay for monitoring the contacts of the float-operated switch, whereby this voltage is switched off following completion of a replenishing cycle.

10. Pig-charging apparatus according to claim 8, wherein the electrical control means can be manually switched to charge one pig at a time, or to effect automatic replenishment.

11. Pig-charging apparatus according to claim 1 wherein the fullness of the magazines is monitored by means of inductive proximity-switch means.

12. Pig-charging apparatus according to claim 11 characterized in that a voltage is applied by said proximity switch means to switch on an alarm device.

13. Pig-charging apparatus according to claim 12 wherein the alarm device can be disabled by actuating a cancelling button which is operatively connected to said proximity switch means.

14. Pig-charging apparatus according to claim 4 wherein the pneumatic cylinder means can be triggered by means of a sequential control device with a plurality of control lines, compressed air being admitted to these lines in a sequential manner.

15. Pig-charging apparatus according to claim 14 wherein first, second and third control lines are provided, and the blocking cylinder is connected to the first and third control lines and the cylinder means for controlling rotating and locking of said magazine assembly are connected to the first, second and third control lines, these connections being made in the case of each cylinder means via a main directional control valve which can be actuated by means of the control lines.

16. Pig-charging apparatus according to claim 15 wherein a locking cylinder and a shifting cylinder perform the function of locking said assembly and advancing it respectively, and wherein the main directional control valve which is allocated to the locking cylinder possesses a connecting line leading to the second control line, a pilot valve which is actuated by the piston rod of the blocking cylinder while this main directional control valve possesses another connecting line leading to the second control line, and a pilot valve which is actuated by the piston rod of the shifting cylinder.

17. Pig-charging apparatus according to claim 15 further comprising a pilot valve which is actuated by the piston rod of the shifting cylinder, located in the connecting line between the third control line and the blocking cylinder.

18. Pig-charging apparatus according to claim 14 wherein a main compressed air line is connected to the three control lines by means of a "one of three" interconnection valve means.

19. Pig-charging apparatus according to claim 18 wherein the "one of three" interconnection valve means comprises a first 4/2-way valve and a second 4/2-way valve which are series-connected, a pilot valve actuated by the piston rod of the locking cylinder, located in the first connecting line of the first directional control valve, this line leading to the first control line, and a pilot valve actuated by the piston rod of the shifting cylinder located in the first connecting line of the second directional control valve, this line leading to the second control line.

20. Pig-charging apparatus according to claim 19 wherein the second connecting line of the first directional control valve is led to the third control line.

21. Pig-charging apparatus according to claim 19, wherein the second connecting line of the second directional control valve is the output of an AND-gate, one input of which is connected to the third control line and the other input of which is the float operated switch.

* * * * *